US005453054A

United States Patent [19]

Langford

[11] Patent Number: 5,453,054

[45] Date of Patent: Sep. 26, 1995

[54] CONTROLLABLE WATERSLIDE WEIR

[75] Inventor: Frederick Langford, Cape May Court House, N.J.

[73] Assignee: Waterworld Products, Inc., Cape May Court House, N.J.

[21] Appl. No.: 247,054

[22] Filed: May 20, 1994

[51] Int. Cl.[6] ..... A63G 21/00

[52] U.S. Cl. ..... 472/117; 472/117; 405/79

[58] Field of Search ..... 472/116, 117, 472/128, 88; 239/193; 405/79, 92, 91, 87; 137/101.27; 104/69, 70

[56] References Cited

U.S. PATENT DOCUMENTS 4,797,027 1/1989 Combes et al. ..... 405/92
4,963,057 10/1990 Fournier ..... 405/92 X
5,137,497 8/1992 Dubeta ..... 472/117 X
5,194,048 3/1993 Briggs ..... 472/128
5,213,547 5/1993 Lochtefeld ..... 472/117

*Primary Examiner*—Carl D. Friedman
*Assistant Examiner*—Kien T. Nguyen
*Attorney, Agent, or Firm*—Eckert Seamans Cherin & Mellott

[57] ABSTRACT

A waterslide has a controllable weir operable to increase the release of water from an upstream pool upon sensing an approaching rider, and is particularly arranged for riders on flotation devices coupled into arrays. The weir has vertically pivotable damming structure across a local peak in the sluice at the exit point of the pool. Photosensors detect approaching riders and signal a controller to open the weir momentarily to pass the rider and a gush of water, by operation of a pneumatic linkage. Between operations a continuous flow of water increases the depth in the pool. The weir can be high enough to block passage of riders when raised, allowing timed release.

6 Claims, 10 Drawing Sheets

CONTROLLABLE WATERSLIDE WEIR

BACKGROUND OF THE INVENTION

1. Field of the Invention

The invention relates to the field of waterslides, and flotation devices optimized for particular types of waterslide. At least one controllable weir is provided along a waterslide course through which water flows continuously, and preferably the waterslide has a series of weirs, each associated with a pool of water. The weirs normally are raised, for example being operated by pneumatic means, to accumulate a quantity of water in the pool behind it. Sensors detect riders in the pool approaching the weir, and trigger lowering of the weir such that a surge of water accompanies the riders along the descending course following the weir. The course is wide enough for a plurality of riders on flotation tubes, riding side by side, and the invention also concerns an improved flotation tube for use on the waterslide. The tube has rider support and safety features, and coupling mechanisms for attaching the tubes into arrayed groups forming lines, stars and the like.

2. Prior Art

A waterslide comprises a generally descending elongated trough or sluice through which water flows, with riders sliding in the sluice. Most waterslides describe a continuously descending path from a starting point at the top of a support structure to a splash-down pool at the end. Examples are shown in U.S. Pat. Nos. 5,011,134 and 5,020,465, both to Langford, the latter also disclosing means to accommodate an uphill run along the course, making the course like that of a rollercoaster. These patents are hereby incorporated in their entireties.

The structure and character of waterslides vary widely, from short poolside sliding boards to long and elaborate courses. The surfaces of the sluice must be wet for sliding, but there are wide variations in the volume of water used. A waterslide may use a light spray simply to wet the surface of the sluice, or a substantial volume may flow in the sluice along with the riders. Fast, long or complex courses typically require that the rider lie or sit on a sliding pad or buoyant vessel such as an inflated tube.

Water is released into the sluice at the top of the course, and optionally can be introduced at intermediate points, for example being sprayed on side walls of the sluice at turns. The water flows downwardly by gravity, is collected at low points and is pumped back to the top. The course can be arranged such that the riders plane over the water in excess of the velocity of the water, but normally the water and the riders move together. Where the water is relatively deep, hydrodynamic friction reduces the speed of the riders to match the flow rate of the water.

A waterslide course may have a succession of faster and slower runs. At intermediate pools and at wider points in the sluice, the riders can be slowed. Such variations, together with variations in the slope or gradient of the descent and the volume of water, affect the riders' speed at different points along the course and make the ride interesting. These variations also control the length of time required to traverse the course.

Typically, the water flows continuously from the extreme top to the extreme bottom of the course. The water flow rate also affects the character of the ride. A narrow sluice or one with only minimal water for the rider to skim over makes for a different experience than a wider sluice or a high volume flow in which the rider is carried along by the water, e.g., floating on the flow. It is advantageous in a given ride to provide interesting variations in flow along the course, even though water is pumped at a steady rate from bottom to top. These variations are provided, for example, by changes in the width of the sluice (wider sections having shallower water) and in the elevation of the sluice (pools forming behind raised sections).

A substantial flow of water can be exciting, particularly in connection with a tortuous path, steep gradients, intermediate pools and other features. Typically, high capacity pumps recirculate the water from a splash-down pool at the bottom of the course to the rider entry point at the top, which may have a starting pool. The electric power needed to pump the water is one of the major operating expenses of a waterslide facility. The rider is propelled by the force of gravity and is carried along with any water moving together with the rider. The rider is hindered by friction between the base or walls of the trough and the rider's body or flotation device, and insofar as the rider may slide faster than the water flows (e.g., at depressions or at intermediate pools), the rider is slowed by fluid drag from the water.

Maintaining a high volume stream of flowing water presents several additional demands. The weight of a large volume of water in the sluice or trough requires a larger supporting structure than for a smaller volume. Enough pump capacity must be provided to lift the water at the high volume rate, from the splashdown pool to the top of the trough. The greater amount of water and resulting turbulence may require higher sidewalls to contain the water and the riders in the trough. The water itself is also an expense.

The present invention is intended to provide the advantages of a high volume flow, and the potential for substantial variations in the character of the course, by producing time variations in the water flow volume at particular spans along the course, such as at descents between pools. One or more controllable weirs vary the rate at which water is released at points along the waterslide. Water flows continuously along the course, but when the weir is raised, the depth of water behind the weir increases. When the weir is lowered, the accumulated additional water is released such that the flow increases momentarily. The weir is operated in coincidence with the passage of riders. Whereas the water moves down the course with the rider, the experience is similar to that of a high volume continuous flow. However, many of the drawbacks of high volume continuous flow are avoided.

U.S. Pat. No. 3,853,067—Bacon teaches that a volume of water can be stored and released down a slope as a priming mechanism for wetting a trough after a period of idleness. Bacon does not attempt to synchronize momentary water release with passing riders, or otherwise to use flow rate variations to affect the motion of the riders apart from reducing friction.

According to a preferred embodiment of the present invention, a series of intermediate pools between the top and bottom of the waterslide are each provided with controllable weirs as described. The weirs can span across relatively wide outlets or mouths of the pools, the weirs forming rounded lips that are lowered abruptly to release a volume of water into a wide sluice downstream of the pool, preferably in coincidence with releasing a rider from the pool. Should no riders pass, water flows over the raised weir at the steady state flow rate and thereby feeds downstream portions of the course.

Known waterslides include arrangements traversed by riders with or without flotation devices. Among the flotation devices currently used in waterslides are mats, air mattresses, and inflated tubes. In the above U.S. Pat. No. 5,020,465—Langford, inflatable tubes are provided with male and female couplings, enabling the tubes to be joined in pairs, grouped arrays or lines. The present invention provides an improved inflatable tube with such coupling devices, adapted to facilitate comfort and safety, and having improved coupling structures for joining and releasing the tubes when necessary.

Riders prefer tubular devices in deeper water. One can ride seated upright in the central opening, and see upcoming portions of the track and other riders, enhancing both the excitement and safety of the ride. Tubes float well, and variations in the depth of the water do not substantially affect the support of the rider. However, tubes can be uncomfortable. They are optimal only for one size of rider, with smaller riders being apt to fall through the hole and larger riders resting on top of the tube without good support for their heads, necks, or backs. In addition, known tubes can be difficult to couple, or when the couplings become worn, too easy to decouple such that they become detached inadvertently.

With good support and dependable couplings, as provided according to the invention, it is safe and exciting to traverse the waterslide in various multiple tube configurations, with individual riders facing forward, backward or sideways.

The controllable weir of the invention comprises a vertically displaceable damming structure positioned across the sluice. The controllable weir preferably is arranged at the downstream end of a starting pool and/or intermediate pool, e.g., at a relative peak formed between an incline in the upstream direction (leading back into the pool) and the downstream downhill section of the sluice or trough. The damming portion of the weir preferably comprises a rounded hollow section with an open bottom, pivoted on a horizontal axis and arranged to be lowered into a complementary lateral depression in the sluice. This damming section can have openings along the downstream side such that lowering the weir ejects water from under the damming section as well as allowing more water to flow over the weir.

A control system senses approaching riders, for example using a photocell to detect obstruction of an optical path by a rider, and triggers the controllable weir to discharge as the rider passes. The continuous flow of water preferably is sufficient to pass over the weir promptly after the weir is raised, but the level of water in the pool behind the weir varies, as does the flow from the pool. As a rider approaches and is detected by the sensors, a solenoid valve responsive to the control system couples a pneumatic system to an air cylinder to lower the weir. The weir can be high enough to block passage of riders when the weir is raised, functioning as a gate to release riders at intervals, the control system including timing means operable to regulate the times at which riders and water are released, thus avoiding downstream collisions or conflicts. The weir then returns to its raised position, backing up water in preparation for the next rider.

The invention is particularly useful for riders coupled in groups. According to a preferred flotation apparatus for use over the weir, a particular coupling device is provided to permit easy coupling into certain types of arrays. The coupling device comprises a coupling prong and receptor ring at the bow of the flotation apparatus, and optionally may comprise one or more receptor rings at the stern. The receptor rings can be placed to limit or to enable intersection of the coupled flotation apparatus in particular configurations or angular relationships.

The prong is provided with a resiliently depressible locking member that protrudes to positively lock the prong to a respective receptor ring when the prong is inserted through the ring. The tab is depressible for detaching the prong from the ring in a quick and easy motion. In a preferred embodiment the locking tab is mounted resiliently to pivot against a sponge member that resiliently loads the tab, or the tab can be mounted using a spring.

When flotation devices are coupled, the incidence of impacts against the devices increases. For example, the coupled devices bump together and against other tubes, portions of the sluice, etc. Such impacts jar the rider and the device. In the preferred embodiment of the invention, bumpers are provided at points where contact between coupled devices is likely, e.g., being incorporated into a positioning plate structure by which the coupling structures are mounted to the tube.

A layer of padding is disposed between the positioning plate and the mounting plate at the bow of the flotation apparatus. The mounting plate is hot welded to the inflatable tube of the flotation device. The mounting plate is attached to include a set of warped areas at which the mounting plate is not directly affixed to the tube, each of which is formed with an enclosed slot for removably accepting the shank and enlarged head of a fastener that releasably fastens the mounting plate and positioning plate together, with the padding layer sandwiched between them. The layer of padding material at least partially absorbs impacts against the bow, which results in a more comfortable ride as well as reduced wear on other parts of the device. The padding can extend upward beyond the mounting and positioning plates to form a comfortable footrest or kicker for supporting the rider. A backrest or headrest can be provided in a similar manner.

SUMMARY OF THE INVENTION

It is an object of this invention to improve the excitement of waterslides by propelling riders along downward-sloping sections of the trough using a high volume of water, without the drawbacks that are normally inherent in a continuous high volume flow.

It is also an object of the invention to improve the versatility of flotation equipment, especially tubular flotation devices, by providing a means for riders to link a plurality of devices to form one of a chain or a closed geometric figure.

It is a further object of the invention to provide a coupling for inflatable tube flotation devices, articulated on mutually perpendicular axes, which is inexpensive, durable, easy to maintain, and easy to operate.

It is a further object of the invention to provide a coupling to join individual rider tubes in waterslides, which enables a line, star, ring or other array of tubes to follow a sinuous path, and which is relatively secure against inadvertent disengagement.

It is a further object of the invention to provide an inflatable flotation tube which improves rider comfort and safety.

These and other objects and aspects are accomplished by an improved waterslide and a flotation apparatus therefor. The flotation apparatus includes an inflatable tube which has a V-shaped bow. Attached to the bow is a mounting plate, to which a positioning plate is affixed with a layer of padding between the two. The mount plate preferably is hot welded to the inflatable tube of the flotation device. The mount plate includes a set of warped areas, each of which is formed with an enclosed slot for removably accepting the shank and enlarged head of a fastener that releasably fastens the mount plate and positioning plate together, with the padding layer sandwiched therebetween. The mounting plate is not attached to the tube adjacent the slot, whereby the enlarged head of the fastener can be fixed between the mounting plate and the tube, with the shank protruding for affixing the padding and the positioning plate.

The positioning plate includes a handle portion, a portion which holds an insert pin, and a portion which attaches to a receptor ring whose internal diameter substantially corresponds to the external diameter of an insert pin, enabling the flotation devices to be coupled at the bow. An insert pin is attached to the insert pin holder and includes a depressible preferably wedge-shaped release button near its distal end. In the interior of the insert pin a resilient material resiliently loads the release button. When manually depressed, the release button becomes flush with the exterior of the insert pin, for decoupling. The release button is forced flush by the insertion of the insert pin into the receptor ring during coupling, and pops back out as it passes the receptor ring for secure coupling. A removable cap at the distal end of the insert pin simplifies maintenance.

The flotation device optionally includes a second coupling connection point at the stern, including two receptor rings, hot welded to the stem of the inflatable tube in the same manner as the structure at the bow, such that multiple tubes can be coupled bow-to-stern to form a geometric figure, or other arrangement.

Padding between the forward positioning and mounting plates and bumpers on the positioning plate reduce wear to the tube; these features plus a footrest and backrest increase rider comfort.

BRIEF DESCRIPTION OF THE DRAWINGS

There are shown in the drawings certain examples of the invention in embodiments that are presently preferred. It should be understood that the invention is not limited to the particular embodiments disclosed as examples. In the drawings.

DETAILED DESCRIPTION OF THE PREFERRED EMBODIMENTS

Figure 1:
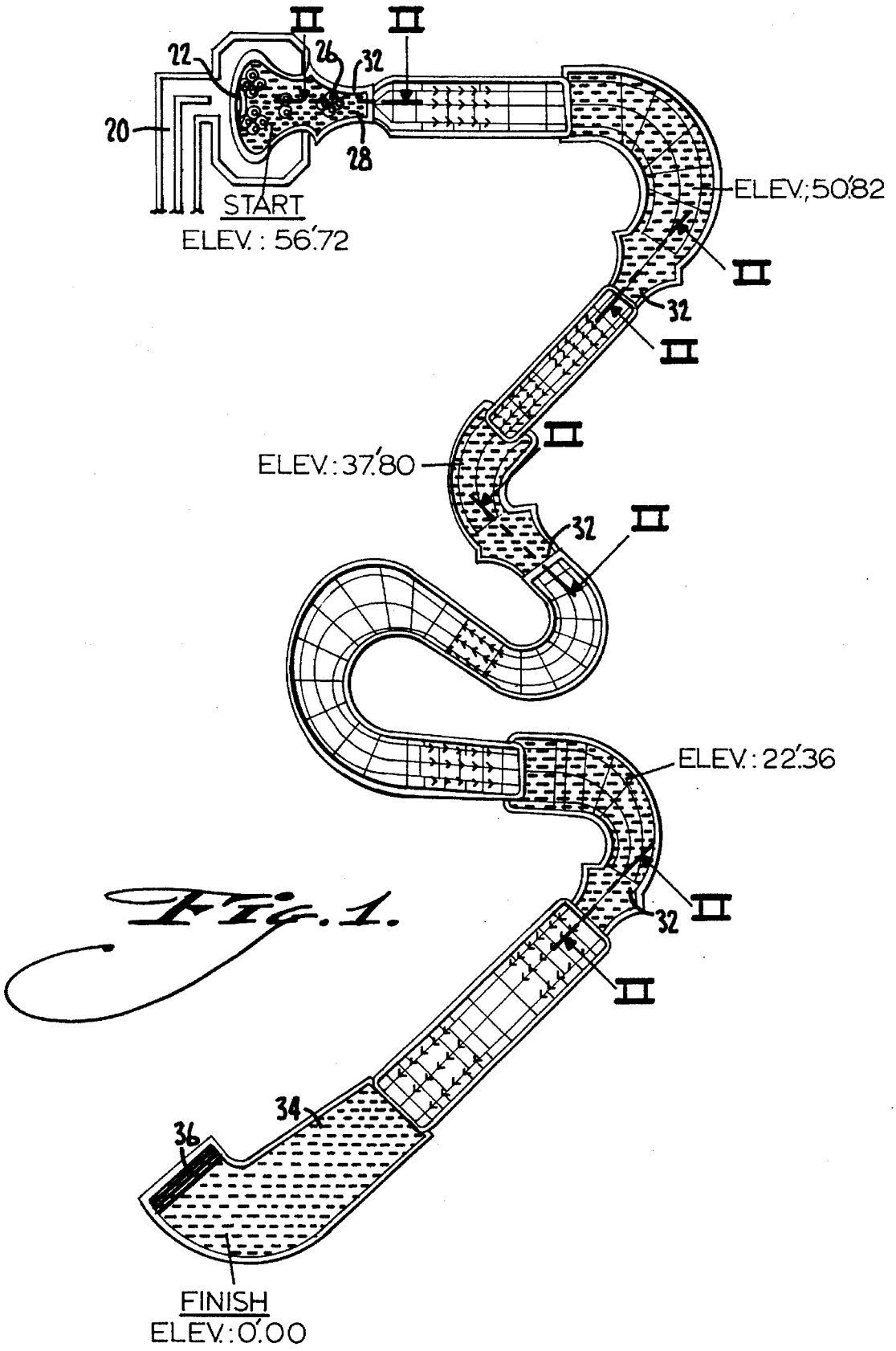
FIG. 1 is a plan view of a waterslide according to the invention.

FIG. 1 is a plan view of an exemplary waterslide according to the invention. Riders form a queue in the entry corral 20. Each rider proceeds down the entry stairs 22 into the entry pool 24, where he or she boards a flotation apparatus 26. While in the entry pool, the riders may couple their flotation apparatus 26 into lines or arrays as illustrated in FIG. 1. Various configurations of pairs, lines and arrays are possible.

Riders move toward the entry pool departure area 28 and pass into the trough 30 of the waterslide. The trough is primarily downward-sloping, although it may contain one or more areas which have an upward slope. The riders are propelled by gravity together with water moving through trough 30, the water being pumped continuously from one or more collection points (e.g., the end or splash-down pool) to the top of the course. While FIG. 1 shows several twists and turns along the course of trough 30, various straight or tortuous route configurations are possible and the embodiment shown is merely an example.

FIG. 1 also features several weirbox sections 32. These sections are described in more detail with respect to FIGS. 2*a*, 2*b*, and 3. At least one such weirbox is employed along the trough 30, and can be placed at any point along the route.

Preferably, a weirbox section is used near the beginning of the route, whereby riders depart in a volume of water that substantially accompanies them as they traverse the route. By providing a plurality of intermediate pools and weirboxes, riders can pass slowly through pools between sections at which they move faster. Eventually, the riders reach splashdown pool 34, and disembark from their flotation apparatus 26. The riders exit the waterslide via the exit stairs 36.

Figure 2A:
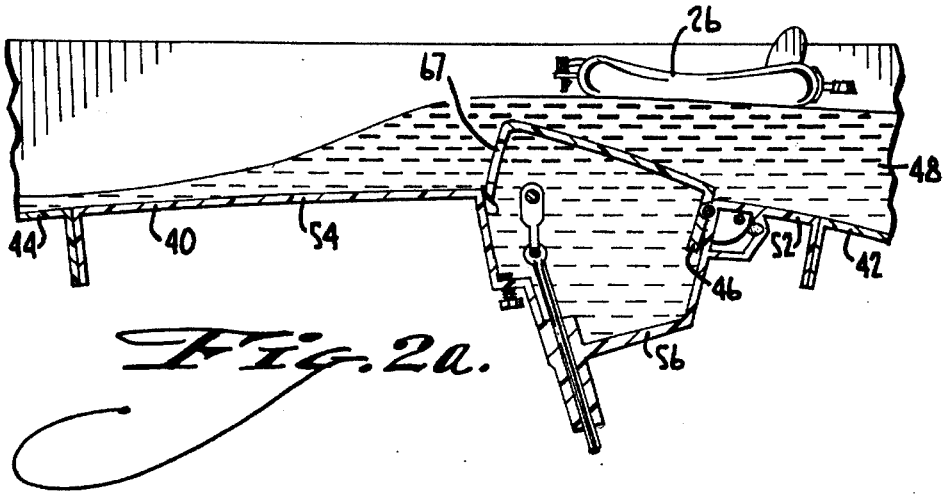
FIG. 2*a* is a section view typical of section cuts taken through any line II—II in FIG. 1, illustrating a flotation apparatus approaching a weir in a raised position.

FIG. 2*a* shows a flotation apparatus 26 moving through a weirbox section 40 embodying the invention. The weirbox section 40 forms a portion of the floor and sides of trough 30 and is positioned between an upward-sloping section 42 and a downward sloping section 44. The weirbox section 40 as shown is mounted at a local peak of the trough 30.

Within the weirbox section 40 itself are an upward sloping segment 52 and a downward sloping segment 54. The slopes of these segments substantially approximate the slopes of the preceding upward-sloping section 42 and the subsequent downward sloping section 44, respectively, of the floor of the trough 30, thus forming a relatively smooth transition between the surrounding sections.

A weirbox recession segment 56 is located between the upward-sloping segment 52 and the downward sloping segment 54. This weirbox recession segment 56 is described in detail with respect to FIG. 3. The weirbox recession segment 56 houses a weir 46 which is capable of being raised or lowered. In FIG. 2*a*, the weir 46 is shown in a raised position, increasing the depth of water 48 in trough 30 at a pool upslope from the weir 46.

As a flotation apparatus 26 approaches weir 46, sensors 50 (not shown in FIG. 2*a*) signal that weir 46 should be lowered. In a preferred embodiment of the invention, the rider breaks an optical path between a light source and a photocell to provide this signal. However, other means can be utilized instead or in addition, for example including a timer or a control switch manually operated by an attendant.

Figure 2B:
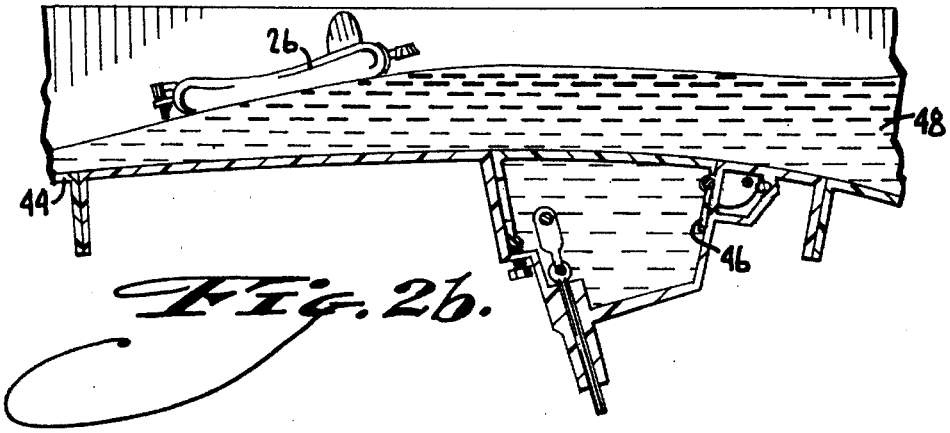
FIG. 2*b* is a section view corresponding to FIG. 2*a*, except that the flotation apparatuses passing over the weir, which is in a lowered position.

FIG. 2*b* shows the weir 46 in its lowered position. The lowering of the weir 46 increases the flow of water 48 by dropping the downstream edge of the pool upslope from weir 46, a gush of water flowing forward through the downward-sloping section 44 of the trough 30. The weir releases the rider and flotation apparatus 26 along with the additional water. The weir 46 can then be returned to its raised position, as illustrated in FIG. 2*a*, to await the arrival of another rider or riders.

The weir operates at intervals corresponding to riders. The flow of water is generally sufficient to pass over weir 46, whether raised or lowered. However, the depth of the water passing over the lowered weir may be several times that when raised. If the weir remains up for a relatively long time, the flow over the weir becomes continuous and equal to the steady state flow rate at which water is being pumped into the entry pool.

Figure 3:
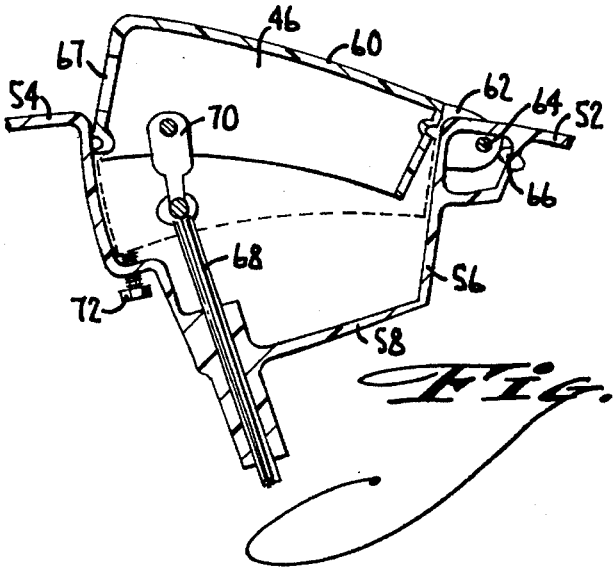
FIG. 3 is an enlarged section view corresponding to FIG. 2*a*, in which the waterslide and weirbox are drained dry.

FIG. 3 depicts the weirbox recession segment 56. A recessed floor 58 defines an area whose dimensions are large enough to accommodate the weir 46 in its lowered position so that the upper surface 60 of the weir 46 defines an arc which provides a relatively smooth transition between the slopes of the upward-sloping segment 52 and the downward sloping segment 54.

A pivoting connection is provided to permit the raising and lowering of the weir 46, preferably pivoting on a horizontal axis at the upstream side of the weir. In the preferred embodiment, a pivot plate 62 is attached to the weir 46 at the end proximal to the upward-sloping segment 52. Attachment means 64 attach the pivot plate 62 to the recessed floor 58 of the weirbox recession segment 56. In the preferred embodiment, the attachment means 64 comprises a bolt which passes through a hole in the pivot plate 62 and attaches it to the wall of the recessed floor 58; however, other means of attachment are possible.

Preferably, the weir is hollow underneath. Water in trough 30 communicates with the weirbox recession segment 56 via a plurality of ventilation openings 67 in the wall of the weir 46 facing the downslope direction of the trough 30. The ventilation openings are preferably smaller than finger size and can be vertical slots. When the weir is lowered, water is ejected on the downstream side of the weir. Each ventilation opening 67 can be, for example, 2 inches (5 cm) tall by ⅜ inch (1 cm) wide, and spaced from adjacent opening by about 3 inches (8 cm) in the horizontal direction.

A pneumatic piston 68 preferably is coupled to an air source via a solenoid valve (not shown) responsive to a control system, and is used to raise and lower weir 46. Other sources of motive power are also possible, such as hydraulic or electric actuators. A pivot plate 70 is flexibly attached to the proximal end of the piston 68 and to the weir 46. Pivot plate 70 translates the straight line motion of the piston 68 into the arcing motion of the weir 46. In the preferred embodiment, the flexible attachment to the piston 68 is provided by a bolt which passes through a hole in the pivot plate 70 and into the piston 68; a similar means of attachment is used to attach the pivot plate 70 to the weir 46. Other means of attachment which provide a flexible connection also may be used.

The preferred embodiment includes a means to prevent the lowered weir 46 from directly contacting the recessed floor 58. Such contact would wear the weir 46 and the recessed floor 58. To prevent contact, a section of the recessed floor 58 toward the downwardly-sloping segment 34 is elevated so that a narrow space exists between it and the bottom of the weir 46 when the weir 46 is in its lowered position. A leveling bolt 72 is inserted into a hole in this elevated section. The leveling bolt 72 protrudes sufficiently from the elevated section of the recessed floor 58 to permit the lowered weir 46 to rest upon it without touching the recessed floor 58 itself. The leveling bolt 72 does not, however, form a protrusion so large that the upper surface 60 of the weir 46 rises noticeably above the slopes of the surrounding segments 52 and 54 of the trough 30 when the weir 46 is in its lowered position.

Figure 4:
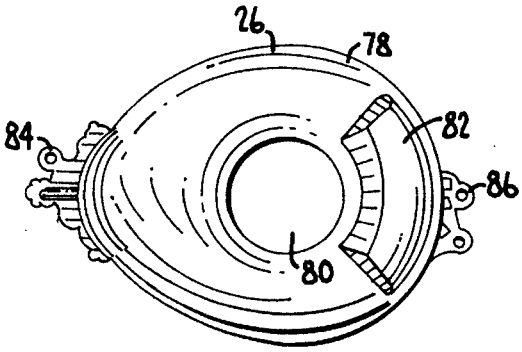
FIG. 4 is a plan view of a flotation apparatus embodying the invention.

FIG. 4 shows the flotation apparatus 26 according to the invention. The flotation apparatus 26 has a tubular buoyant body 78 which defines a central aperture 80, of about the size needed for an average size rider to sit comfortably in the tube with the rider's legs draped over the sides of the tube. The preferred embodiment of the flotation apparatus 26 has a bow which is substantially V-shaped and a stern which is more blunt, providing a tendency for the tube to remain bow-first when proceeding through the water.

The flotation device can be of any buoyant material. However, it is preferred that the tube be made of an inflated skin of fiber with embedded resin. This material is known in the art, for example for air mattresses and tube flotation apparatus lacking the coupling features of this invention. While the invention is described with respect to inflatables, which are the preferred from of flotation device for waterslides and the like, it will be appreciated that other buoyant materials can also be used, for example foamed polyurethane with a wear resistant skin.

A backrest 82 is provided to increase rider comfort and better to adapt the flotation device for a range of rider sizes. The backrest 82 may be integral with the skin of the body of the flotation apparatus 26, but preferably is a separate flexible plastic element that is folded over and attached.

The preferred embodiment of the flotation apparatus includes a bow coupling assembly 84, and may optionally, though not necessarily preferably, include a stern coupling assembly 86, both of which are shown in FIG. 4, and in more detail in FIGS. 5–8 and 15–19.

Figure 5:
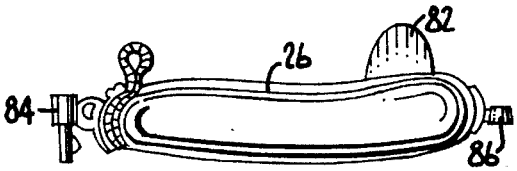
FIG. 5 is a side elevational view of FIG. 4.
Figure 6:
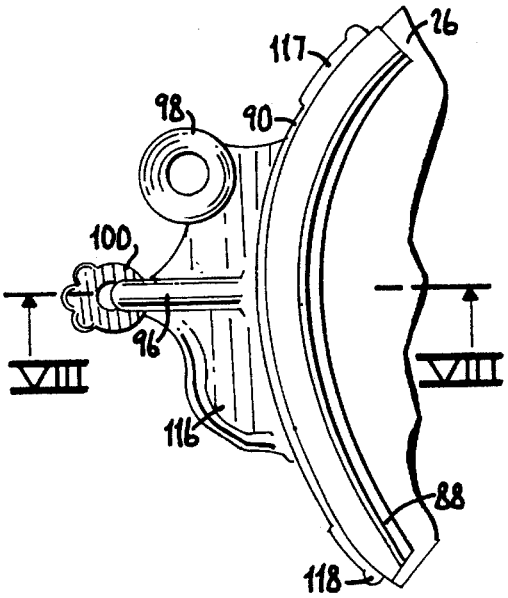
FIG. 6 is an enlarged plan view of the bow of the flotation apparatus in FIG. 4.
Figure 7:
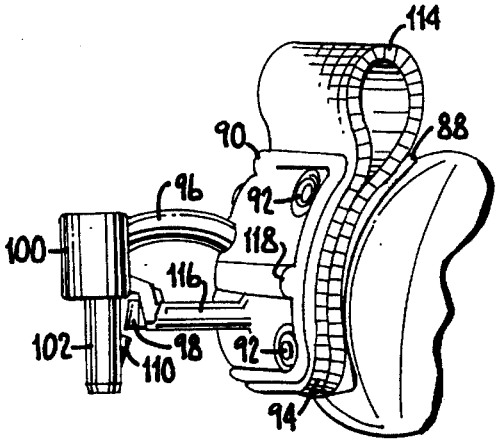
FIG. 7 is a side elevational view of FIG. 6.
Figure 8:
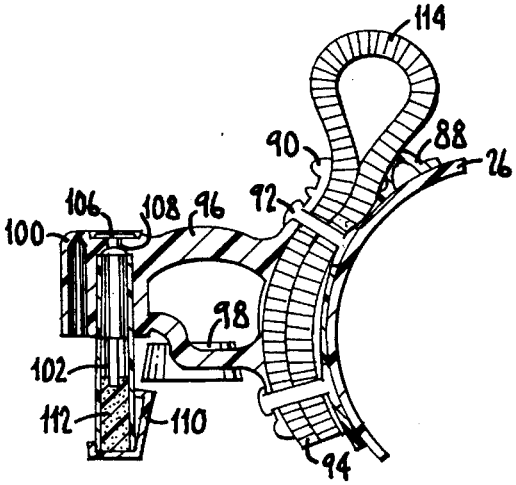
FIG. 8 is a section view taken along line VIII—VIII in FIG. 6.

FIG. 5 is a side elevation view of a flotation apparatus 26 embodying the invention. The backrest 82 is shown in this view, as are the bow coupling assembly 84 and stern coupling assembly 86. FIGS. 6–8 provide a more detailed view of the bow coupling assembly 84. As shown in FIG. 6, the bow coupling assembly preferably includes both a receptor ring 98 and an insert pin holder 100. These components are each attached to a positioning plate 90, which also includes a handle portion 96 to facilitate manual handling of the apparatus, particularly when coupling and decoupling. Several bumpers are included to reduce the impact of collisions on both the rider and the apparatus itself. A cantilevered bumper 116, a rectangular bumper 117, and a half-round bumper 118 each provide protection when the apparatus are coupled in various configurations. Preferably, the positioning plate 90, handle 96, insert pin holder 100, receptor ring 98, and bumpers 116, 117, and 118 are an integrally molded unit of flexible material, for example soft PVC. The soft material allows some articulation by deforming with force.

FIG. 7 provides a side elevation view of the bow coupling assembly 84. Here the positioning plate 90 is shown mounted on the bow of the flotation apparatus 26. A mounting plate 88 (not shown in FIG. 7) is attached to the wall of the flotation apparatus 26. This attachment may be made by means of welding, adhesive, or other methods. Fasteners 92 are used to attach the positioning plate 90 to the mounting plate 88, providing for easy replacement of worn or damaged positioning plates. Other methods of attachment are also possible.

Between the mounting plate 88 and the positioning plate 90 is a layer of padding 94. This padding may be composed of closed cell neoprene or some other material. Its principal purpose is to reduce the impact of collisions on the rider. The padding may also be extended upward to form a footrest or kicker 114.

Handle 96 extends forward from the vertical section of the positioning plate 90 and terminates at the insert pin holder 100. An insert pin 102 extends downward from the insert pin holder 100.

Figure 9:
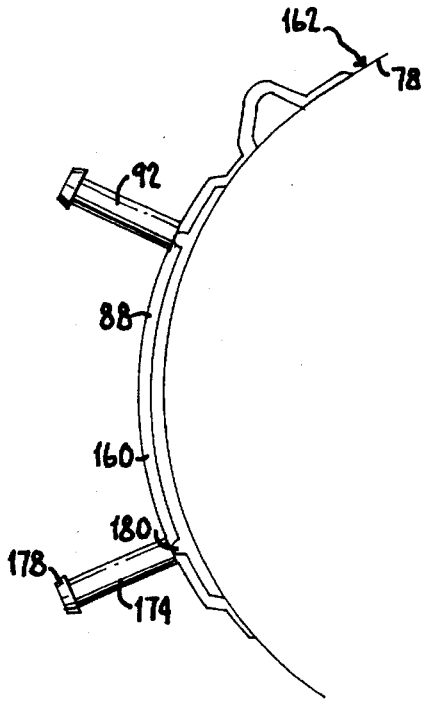
FIG. 9 is a section view taken through line IX—IX in FIG. 10; and corresponds to FIG. 8 insofar as depicting the mounting plate being formed and welded to the shape of the bow of the inflatable tube, but otherwise, the positioning plate and layer of padding,material are removed.
Figure 10:
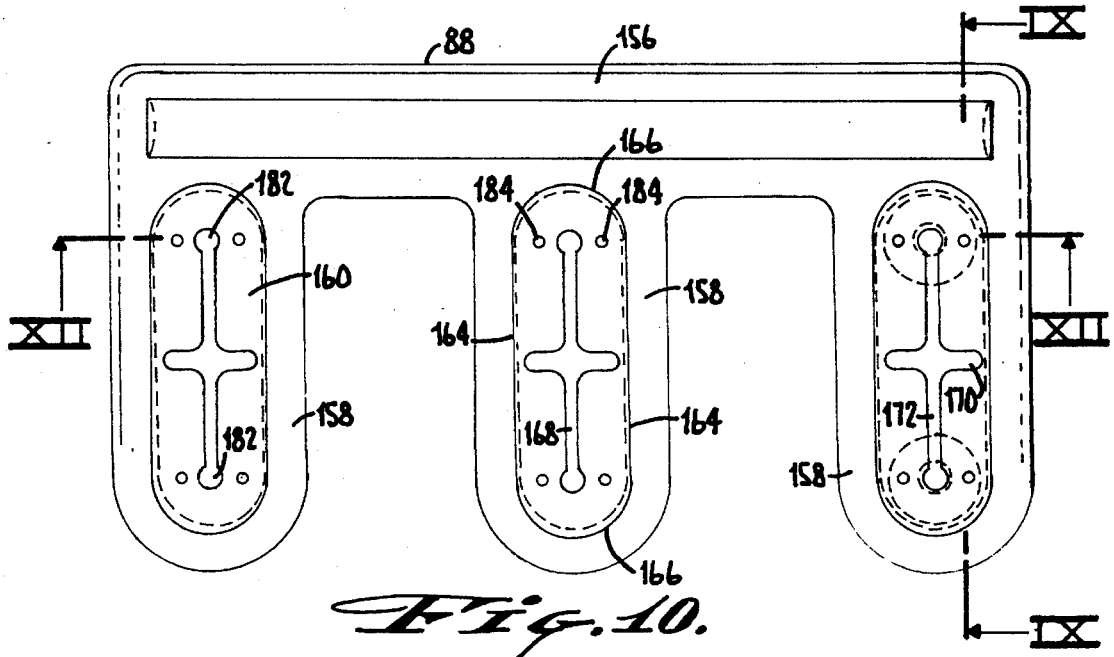
FIG. 10 is an end elevational view of FIG. 9.
Figure 13:
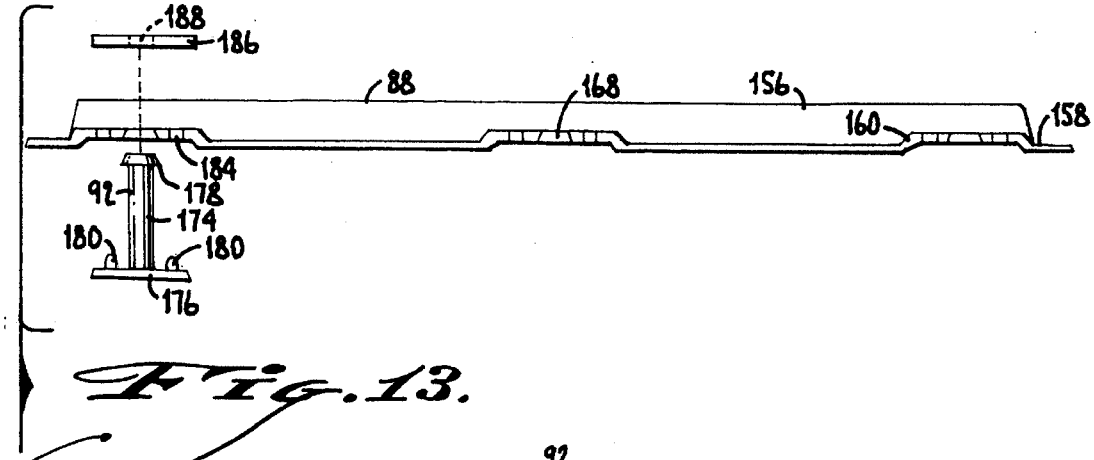
FIG. 13 is a partial section view corresponding to FIG. 12, except that the mounting plate is planar.
Figure 14:
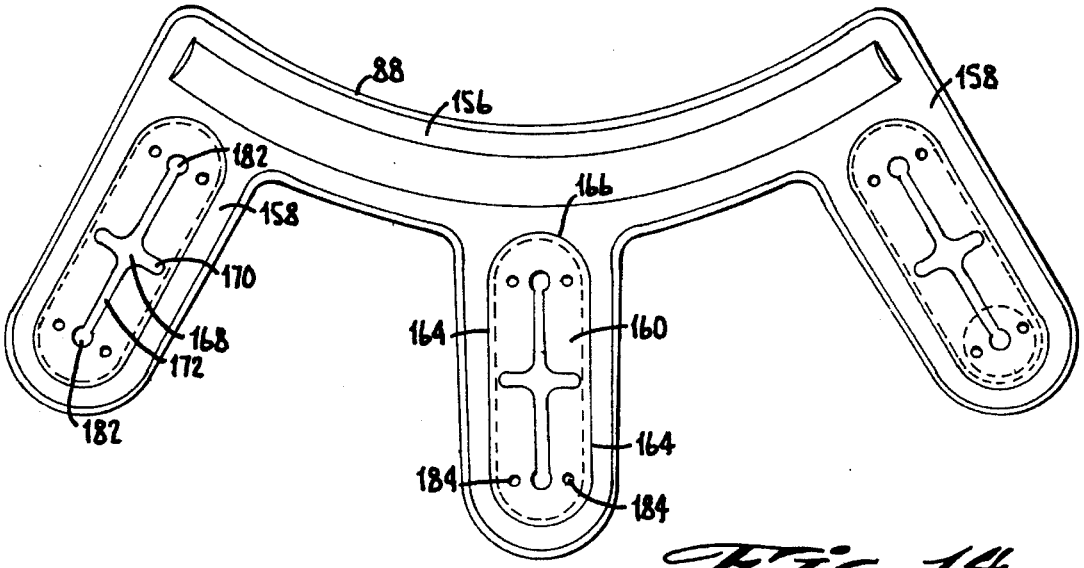
FIG. 14 is an elevational view corresponding to FIG. 10, except that the mounting plate is planar.

FIG. 9 corresponds to FIG. 8 insofar as depicting the bow of the inflatable tube 78 in side section with the mounting plate 88 affixed thereto. However, in FIG. 9, the layer of padding material 94 and the positioning plate 90 are omitted. FIG. 10 corresponds to an end elevational view of FIG. 9. In FIGS. 9 and 10, the mounting plate 88 is shown affixed to the inflatable tube 78, which is the result of forming the mounting plate 88 (which is originally planar as made) around the contours of the bow of the inflatable tube 78, and hot welded in place. The mounting plate 88 can be made from PVC or other suitable material for welding, bonding, or otherwise affixing to the inflatable tube 78. Moreover, PVC is furthermore a suitable material because, even though the mounting plate 88 comes out of a mold in a planar condition, the mounting plate 88 has a shape and arrangement, and is made from suitably resilient material, so that is can be suitably flexed and formed over the blunted bow of the inflatable tube 78. The mounting plate 88 is shown cupped in FIGS. 9–10 and 12 (as when affixed to the bow) and shown planar in FIGS. 11 and 13–14.

The mounting plate comprises an upper web portion 156 from which three finger portions 158 extend downwardly. In the drawings, the mounting plate 88 is shown such that the web portion 156 is horizontal. However, the mounting plate 88 can be mounted in any orientation, and accordingly, terms like "up" and "down", "left" and "right" are used merely for convenience in this description and do not limit the mounting plate. The web portion is size and arranged with respect to the finger portions 158, and the finger portions 158 are spaced apart, all so that the mounting plate 88 can flexed from a planar condition to a cupped condition for affixing to the bow of the inflatable tube 78.

Each finger portion 158 has a central warped area 160 which is normally spaced from the outer surface 162 of the inflatable tube 78 by about 0.10 inch (0.25 cm). The central warped area 160 has spaced parallel sides 164 extending between opposite, semicircular ends 166. Each warped area 160 is provided with an enclosed slot 168 which has a criss-crossed "t"-shape, including a horizontal segment 170 intersecting a vertical segment 172 at a center. The warped areas 160 each provide a space adjacent the slot that is not attached directly, and can receive the head of a fastener 92. Slots 168 thus provide for removable retention of the plurality of fasteners 92 that fasten the mounting plate 88, padding material 94 and positioning plate 90 together in sandwich-like layers.

Figure 11:
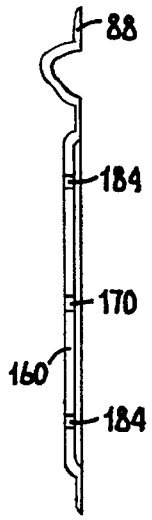
FIG. 11 corresponds to a section view taken through line IX—IX in FIG. 10, except that the mounting plate is planar as it is before being formed to the shape of the bow of the inflatable tube.
Figure 12:
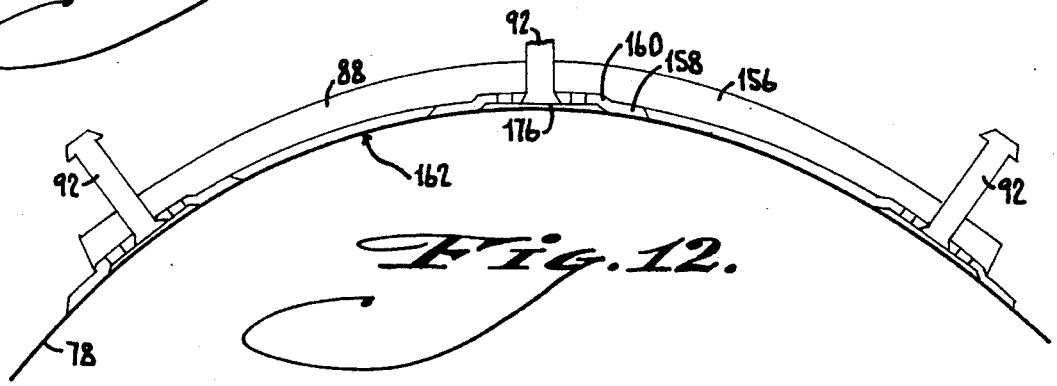
FIG. 12 is a partial section view taken through line XII—XII in FIG. 10, but including additional fasteners.

Each fastener 92 has a shank 174 that terminates in a flat head 176 at one end and wedge-shaped flange 178 at the opposite end. The flat head 176 includes two keys 180 that protrude from the head 176 generally parallel to the shank 174. Each enclosed slot 168 is shaped for removably accepting and retaining one or two fasteners 92 in a desired position. For that purpose, the vertical segment 172 of each slot 168 has opposite enlarged ends 182, each of which is sized for closely surrounding the shank 174 of one fastener 92. The warped area 160 has two keyholes 184 adjacent each enlarged end 182 for accepting the two keys 180 of the head 176 of one fastener 92, as shown in FIGS. 9 and 10. In use, the flat head 176 is placed between and abuts against both the warped area 160 of the mounting plate and the outer surface 162 of the inflatable tube, as shown in FIGS. 9 and 11. The head 176 of the fastener 92 enters and exits the warped areas 160 of the mounting plate 88 in the fashion of sliding edgewise through the horizontal segment 170 of the slot, like a penny in a penny loafer. The vertical segments 172 are sized for resiliently deforming as the shanks 174 of fasteners 92 move therein, which consequently permits removable passage of the fasteners 92 between the horizontal segments 170 and the enlarged ends 182.

The fastener 92 releasably locks on to a flat washer 186 (FIG. 13) to grip between the head 176 and the washer 186 the warped area 160 of the mounting plate 88, the positioning plate 90 and padding material 94 together. To lock with the fastener 92, the flat washer 186 has a central hole 188 which is nearly about the diameter of the shank 174 of the fastener 88. In use, the wedge-shaped flange 178 is forced through the central hole 188 of the washer 186, thereby locking the washer 186 in fastened engagement with the fastener 92. Afterwards, the washer 186 can be pried off the fastener 92 in the reverse direction.

With reference again to FIG. 8, the bow coupling assembly 84 includes the insert pin 102, which is removably held in the insert pin holder 100 by forcing the head 106 through a narrow opening 108 in the insert pin holder 100. This permits the removal of the insert pin 102 for maintenance or replacement while providing a secure attachment not dislodged during normal use. A release button 110 protrudes from the insert pin 102 near its distal end. A resilient material 112 within the insert pin 102 forces the release button 110 to protrude beyond the exterior of the insert pin 102 during its rest state, and lateral inward force presses the release button 110 flush with the exterior of the insert pin 102. In the preferred embodiment, sponge is used to provide this resilient material 112; however, other materials such as springs could also be used. A removable endcap allows easy replacement of the resilient material 112. When coupling the flotation apparatus by inserting the pin, the button 110 retracts due to pressure from its mating receptacle. For decoupling, the button 110 is depressed manually.

Figure 17:
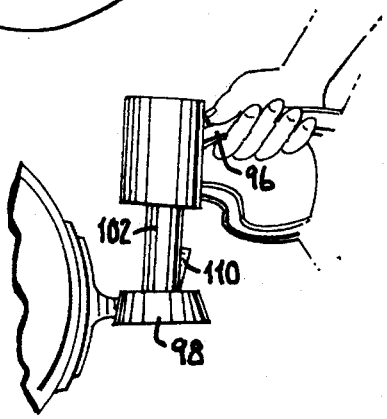
FIG. 17–19 are side elevational views corresponding to FIG. 16, depicting the coupling and decoupling of two flotation apparatus.
Figure 18:
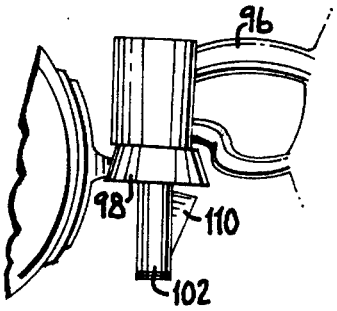
Figure 19:
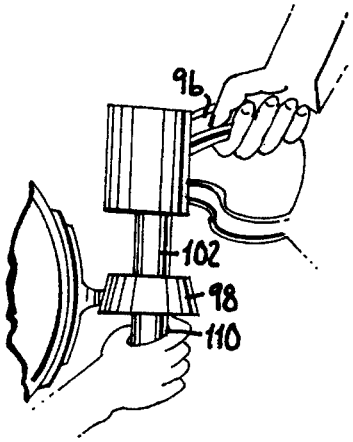

As shown in FIG. 8, the receptor ring 98 is vertically positioned between the lower end of the insert pin holder 100 and the upper end of the release button 110. The interior diameter of the receptor ring 98 is substantially equal to the exterior diameter of the insert pin 102, excluding the protrusion created by the release button 110 in its rest state. FIGS. 17–19 illustrate the use of this coupling mechanism. In FIG. 17, the user has grasped the handle 96 of the bow coupling assembly 84 of one flotation apparatus 26, which he or she then lifts and guides into the mating receptor ring 98 of a second apparatus 26. The wedge shape of the release button 110 compresses the release button 110 flush with the exterior of the insert pin 102. When the release button clears the receptor ring it pops back due to the resilient material 112 behind the button, locking the coupling in position. For decoupling, the user depresses the button 110 and reverses the process.

Figure 15:
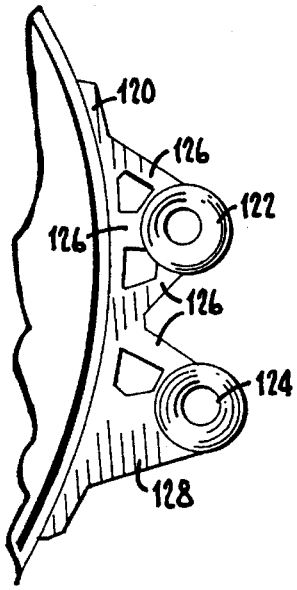
FIG. 15 is an enlarged plan view of the stern of the flotation apparatus in FIG. 4.

FIG. 15 shows the stern coupling assembly 86. A mounting plate 120 is attached to the flotation apparatus 26. Struts 126 and a positioning plate 128 are used to attach receptor ring 122 and receptor ring 124 at a distance from the body of the flotation apparatus 26. Receptor ring 122 is positioned such that a second flotation apparatus 26 coupled at this ring will follow in a straight line behind the first flotation apparatus 26 when coupled in line.

Figure 20A:
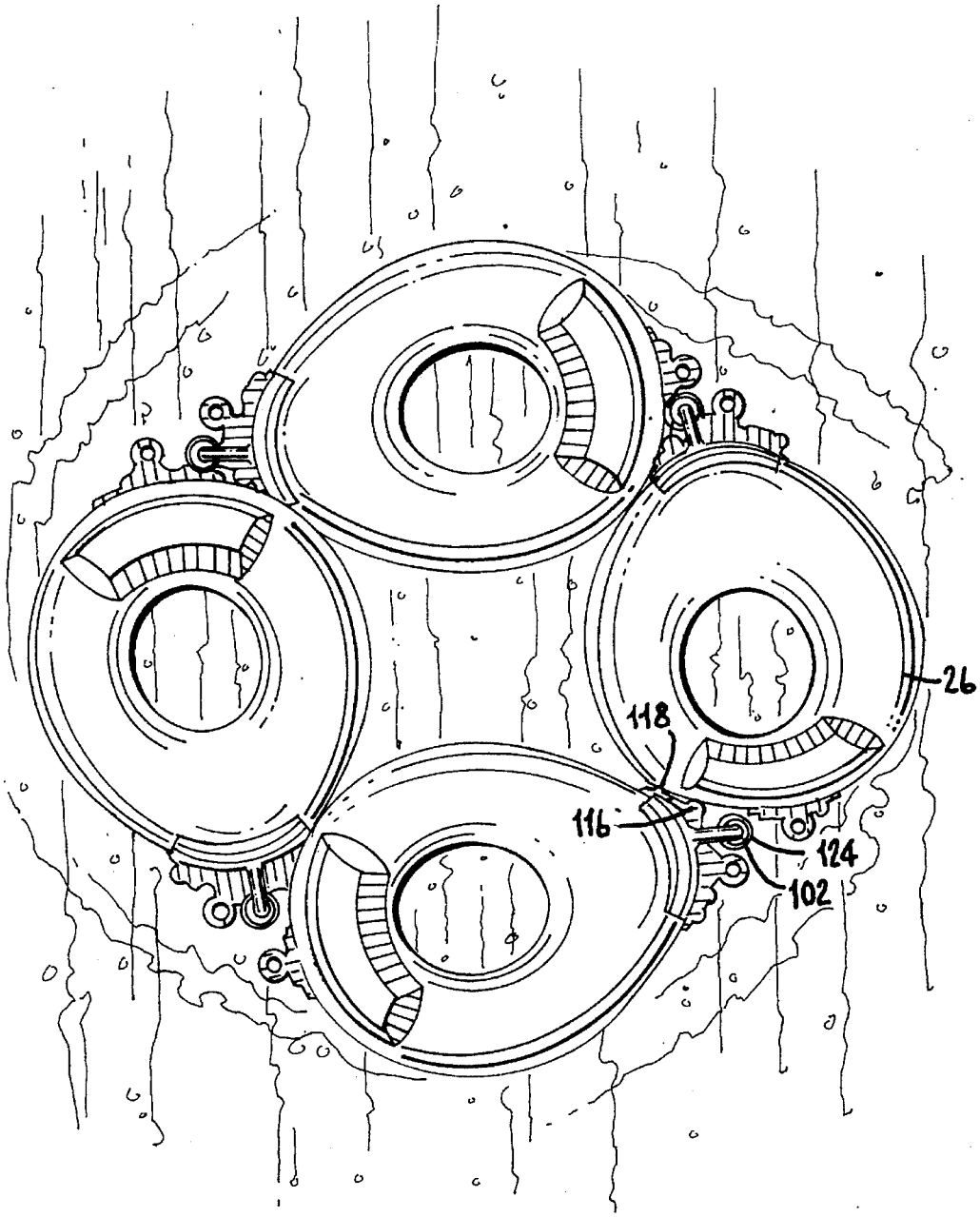
FIG. 20*a*–20*c*are plan views depicting various arrangements in which a plurality of flotation apparatus are coupled together; namely, in a circle, as spokes radiating from a center, and in a line, respectively.
Figure 20B:
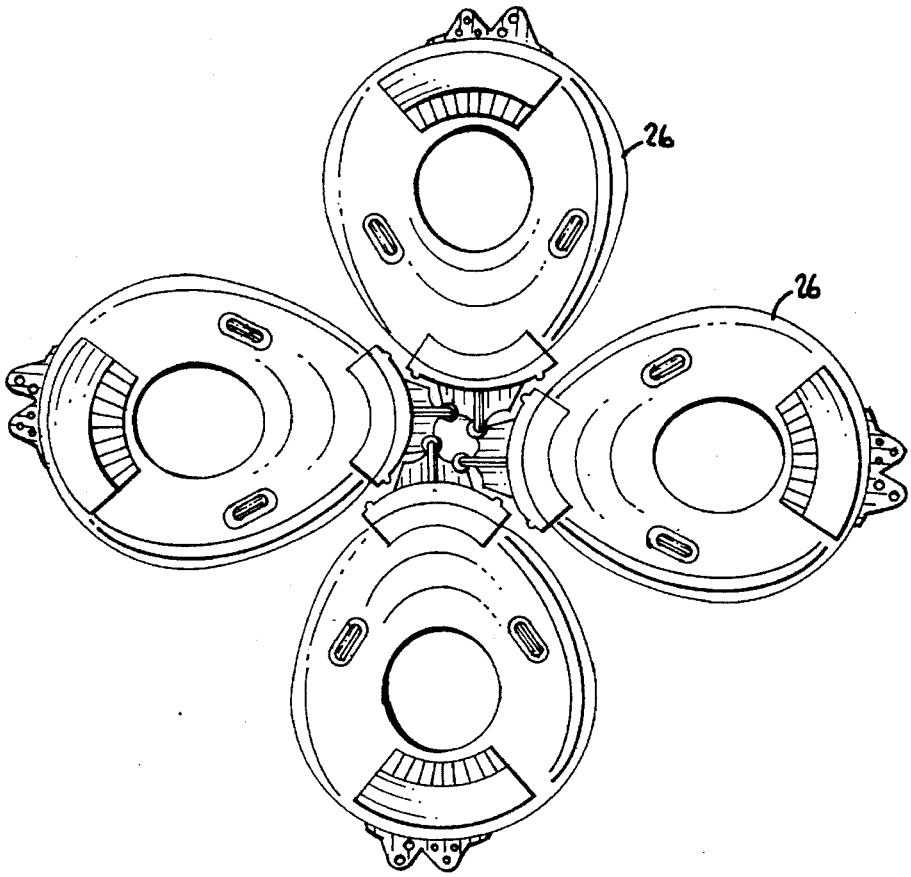
Figure 20C:
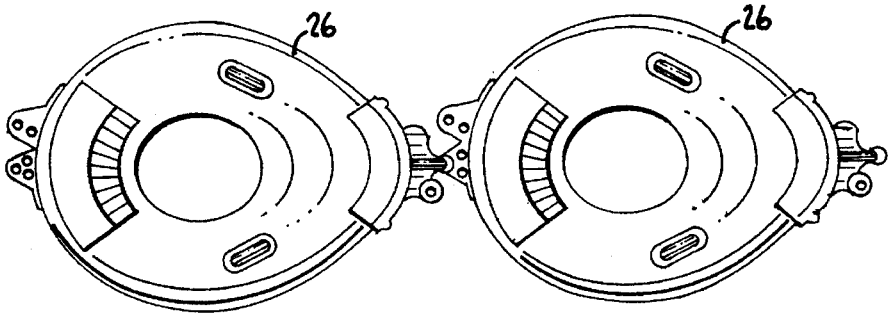

The receptor ring is spaced from the wall of the tube or the like. In conjunction with the narrow bow of the flotation apparatus, the receptor ring and pin configuration permits sufficient clearance to couple the apparatus in circles of four, as shown in FIG. 20*a*, without deformation of the tubes. It is preferred, however, that the stern coupling assembly 86 be omitted, in which event a plurality of tubes can be configured as spokes radiating from a center, as shown in FIG. 20*b*. However, inclusion of a stern coupling assembly 86 also permits tubes to be coupled in a line, as shown in FIG. 20*c*. With some deformation, the tubes with stern coupling assemblies can be coupled in a circle of three. Positioning plate 128 provides support to counter the additional stress placed on the stern coupling assembly 86 when the circular coupling configuration is used.

Figure 24:
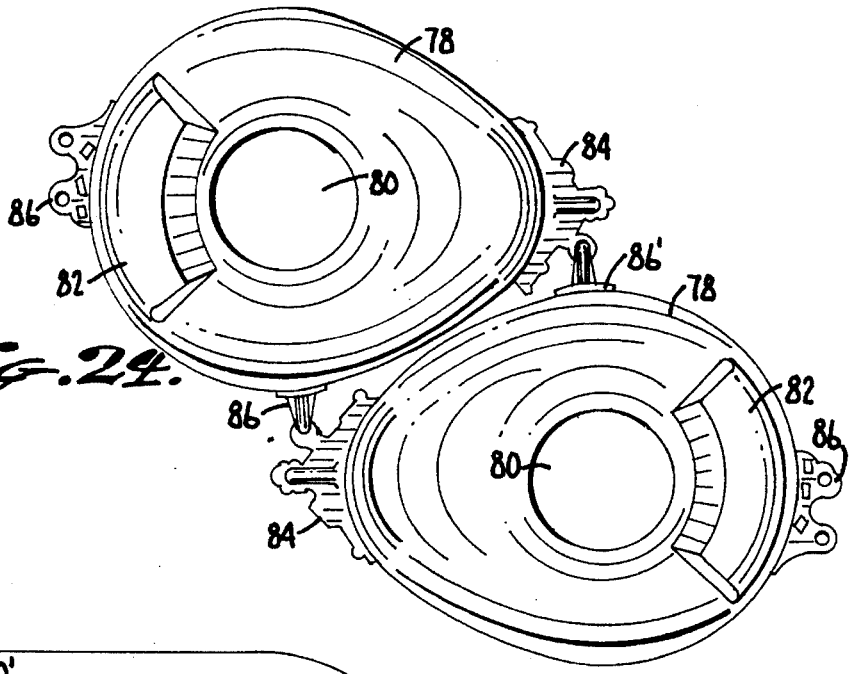
FIG. 24 plan view corresponding to FIGS. 20*a*–20*c*, depicting a pair of flotation apparatus coupled together side via a by side-coupling assemblies welded to a right side of each flotation apparatus.

Of course it is also possible to use other coupled configurations because the bow and stern of each flotation apparatus can be coupled to one or two other flotation apparatus. Indeed, with reference to FIG. 24, a pair of tubes are mounted with side coupling assemblies 86'. the side coupling assemblies permit the pair of tubes to be coupled side by side, yet facing in opposite directions. And still other configurations are possible in accordance with the teachings of the invention.

Figure 16:
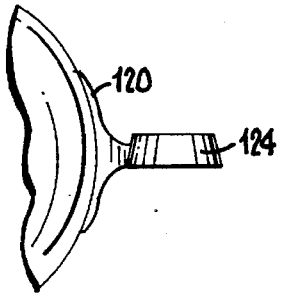
FIG. 16 is a side elevational view of FIG. 15.

FIG. 16 is a side view of the stern coupling assembly 86. Both receptor rings 122 (not visible in FIG. 16) and 124 are positioned at the same vertical displacement from the water as receptor ring 98 at the bow of the flotation apparatus, permitting use in the same manner as illustrated in FIGS. 17–19.

Figure 21:
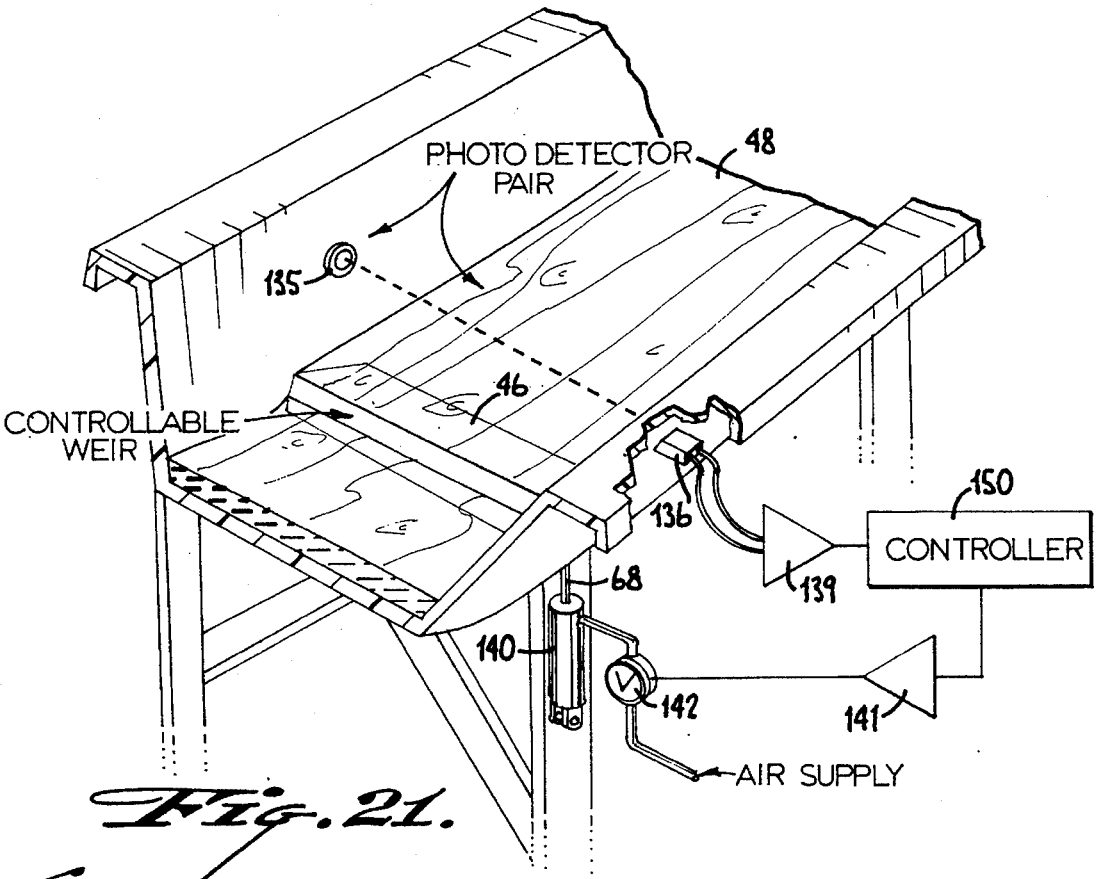
FIG. 21 is a an enlarged perspective view of a portion of the waterslide of FIG. 1, partly broken away, and includes one of the weirs.

FIG. 21 illustrates electrical and control arrangements for raising and lowering the controllable weir. A photodetector pair 135, 136 is mounted to provide a beam that is interrupted by a rider approaching weir 46. The photodetector output is coupled via amplifier 139 to controller 150, which can be more or less complex, and preferably is coupled to control several weirs along the course. The controller may regulate the times at which the weir is opened, for holding back and therefore spacing the riders, or may simply open the weir momentarily whenever a rider approaches. The controller preferably comprises a programmable controller or a microprocessor arranged to accomplish control of the weir and other functions associated with the waterslide. The photocell signal also can be used to trigger other functions, such as operating sprays or fountains when a rider comes within range. The output of controller 150 is coupled by driver 141 to a solenoid valve 142 for operating a pneumatic cylinder 140. The cylinder can be connected to drive the weir in both directions, or the weir can be mounted via a spring return mechanism (not shown).

Figure 22:
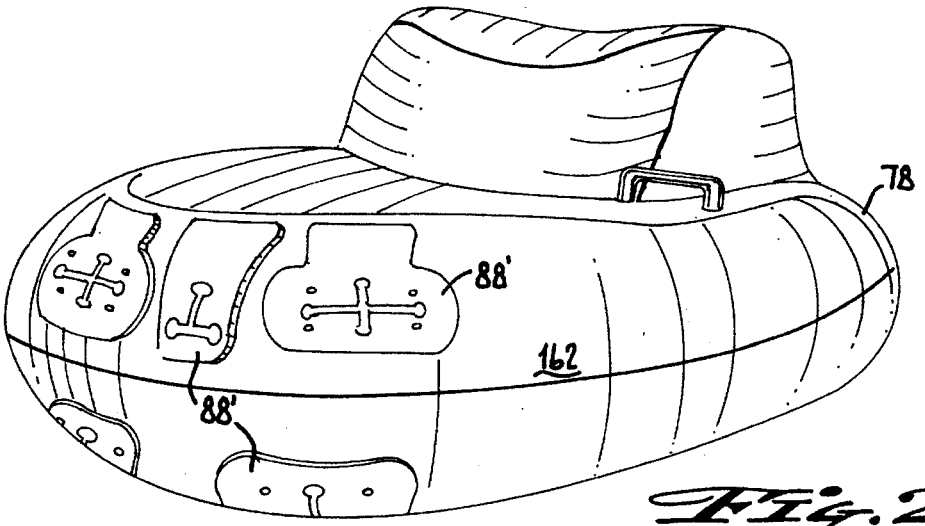
FIG. 22 is a perspective view of alternative mounting plates formed and welded to the shape of the bow of the inflatable tube, but otherwise, the positioning plate and layer of padding material are removed.
Figure 23A:
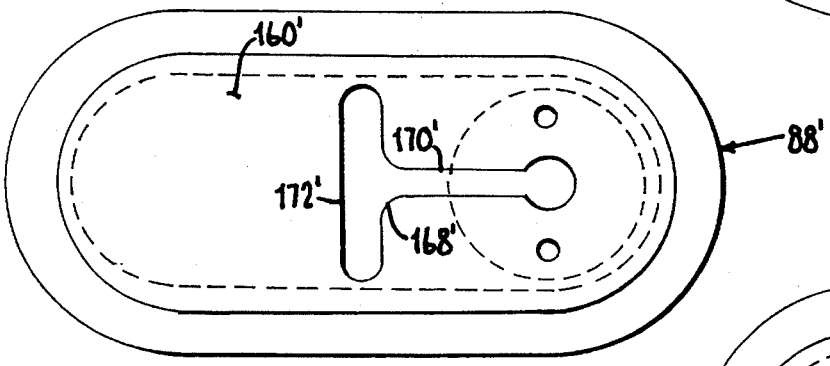
FIG. 23*a*–*b* are enlarged side elevational views of the alternative mounting plates in FIG. 22.
Figure 23B:
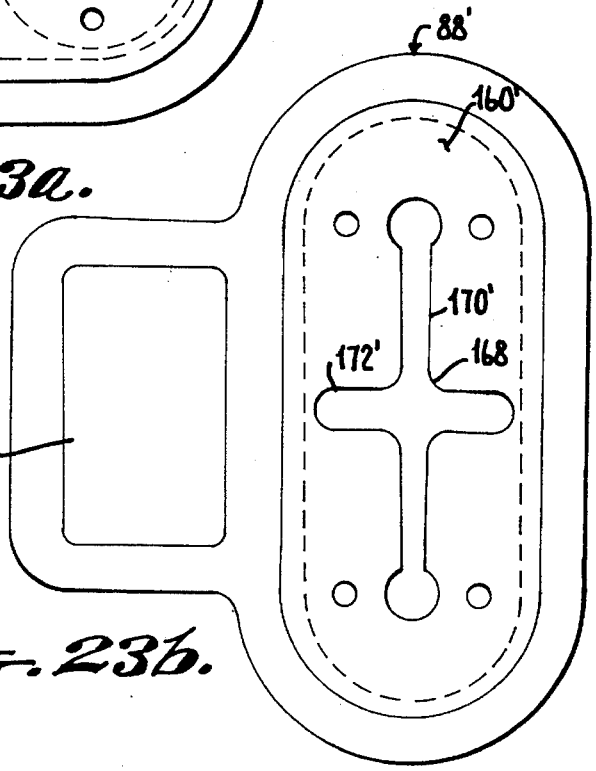

FIG. 22 shows an alternative arrangement of mounting plates 88'. The mounting plates 88' generally correspond to the finger portions 158 in FIGS. 10–14 being sparated from each other, with some mounting plates 88' including an upper web portion 156'. The mounting plates 88' are arranged and spaced apart as shown in FIG. 22. FIGS. 23*a* and 23*b* show two versions of the mounting plates 88', which are formable to a cupped condition for affixing to the bow of the inflatable tube 78.

Each mounting plate 88' has a central warped area 160' which is normally spaced from the outer surface 162 of the inflatable tube 78 by about 0.10 inch (0.25 cm). Each warped area 160' is provided with an enclosed slot 168'which has a criss-crossed segments 170' and 172'. The warped areas 160' each provide a space adjacent the slots 168' that is not attached directly, and can receive the head of the fastener 92 (see FIGS. 9–10 and 12). Slots 168' thus provide for removable retention of the plurality of fasteners 92 that fasten the mounting plates 88', padding material 94 and positioning plate 90 together in sandwich-like layers.

The invention having been disclosed in connection with certain preferred examples, variations will now be apparent to persons skilled in the art. The invention is not intended to be limited to the embodiments disclosed as examples. Accordingly, reference should be made to the appended claims rather than the foregoing examples, to assess the scope of the invention in which exclusive rights are claimed.

I claim:

1. A waterslide, comprising:

an elongated trough defining a rider path proceeding generally from a higher elevation to a lower elevation, the trough having a downward gradient whereby a rider can traverse the path substantially by force of gravity;

means for injecting water into the trough adjacent a point of relatively higher elevation of the trough along the path, thereby establishing a gravity flow of water in a forward direction relative to the rider path along the downhill section of the trough toward an area of relatively lower elevation;

a controllable weir spanning across the trough, the weir being mounted to move between a raised position at which the weir blocks at least a portion of the water, forming a pool, and a lowered position at which the weir releases water from the pool.

2. The waterslide according to claim 1, further comprising drive means coupled to raise and lower the weir, and a controller coupled to the drive means.

3. The waterslide according to claim 2, further comprising at least one sensor for signalling the controller upon detecting a rider in the pool, and wherein the controller is operable to lower the weir for releasing the rider with the water from the pool.

4. The waterslide according to claim 3, wherein the weir is disposed at a lip along a downstream edge of the pool, the lip having a higher elevation than a bottom of the trough in the pool, whereby the pool retains a quantity of water when the weir is lowered.

5. The waterslide according to claim 2, further comprising a sensor operable to detect a rider along the trough and wherein the controller includes timing means, the controller being operable to lower the weir upon at least one of sensing the rider and sensing passage of a predetermined interval of time.

6. The waterslide according to claim 2, comprising a pivoting connection attaching the weir to the trough, the drive means including a piston attached to the distal end of the pivoting connection.

* * * * *